US011970244B1

(12) United States Patent
Canela et al.

(10) Patent No.: US 11,970,244 B1
(45) Date of Patent: Apr. 30, 2024

(54) BOAT AWNING DEVICE AND SYSTEM

(71) Applicants: Ramon Canela, Pompano Beach, FL (US); Fernando E. Volante, Coral Gables, FL (US)

(72) Inventors: Ramon Canela, Pompano Beach, FL (US); Fernando E. Volante, Coral Gables, FL (US)

( * ) Notice: Subject to any disclaimer, the term of this patent is extended or adjusted under 35 U.S.C. 154(b) by 0 days.

(21) Appl. No.: 17/373,626

(22) Filed: Jul. 12, 2021

Related U.S. Application Data

(60) Provisional application No. 63/053,511, filed on Jul. 17, 2020.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS 2,634,740 A * 4/1953 Duke ..... B63B 17/02 114/361
3,032,046 A * 5/1962 Coonradt ..... B63B 17/02 114/361
9,194,152 B1 * 11/2015 Plasencia ..... B63B 17/02
11,220,312 B2 * 1/2022 Jesewitz ..... B63B 17/02

* cited by examiner

*Primary Examiner* — Lars A Olson
(74) *Attorney, Agent, or Firm* — David P. Lhota, Esq.; Lhota & Associates, P.A.

(57) ABSTRACT

An extendable and retractable boat awning device that is mountable on at least one side of a boat to a boat roof top so that when the awning device is opened it allows people in the water to swim or float in shade outside the boat and is retractable when it is no longer needed, or the boat is preparing to move wherein it generally includes a canopy assembly and a support base that is mountable to the roof of a boat wherein the canopy assembly is pivotally attached at one end to the support base by a plurality of pivoting support rods that support and extend a flexible canopy and the support base includes an encasement, encasement cover, a plurality of base mounting assemblies each having a mounting beam extending from a ceiling mounting plate wherein the ceiling mounting plate is mountable to a boat roof for supporting the boat awning device on the boat and that may be easily removed from the boat.

13 Claims, 16 Drawing Sheets

BOAT AWNING DEVICE AND SYSTEM

CROSS-REFERENCE TO RELATED APPLICATION

This application claims the benefit of U.S. provisional patent application Ser. No. 63/053,511 filed Jul. 17, 2020.

STATEMENT REGARDING FEDERALLY SPONSORED RESEARCH OR DEVELOPMENT

N/A

FIELD OF THE INVENTION

The present invention relates to a boat awning device, and in particular, to an extendable and retractable boat awning device that is mounted to a boat roof top or tower to provide shade around the exterior of the boat over the water or a conspicuous target in the event the boat is stranded or lost.

BACKGROUND OF THE INVENTION

Various boat canopies or shade devices are known for attaching or mounting to a boat to provide additional shade in the boat. Boats typically have a tower, hard top or other roof top structure to provide shade in a boat. Roof top structures known for boats normally only provide shade for the driver or captain of the boat so passengers can be out in the open enjoying the sun. However, there are times when passengers may desire to be in the shade for comfort or to avoid overexposure to the sun. Accordingly, attempts have been made to provide extendable shade coverings that extend over the interior of the boat to provide shade over a larger area. The extendable shade coverings known, however, are complicated in structure and are not mountable or conveniently mountable to an existing boat rooftop and are not extendable outside the perimeter of the boat in a manner that provides shade when the passengers are swimming or otherwise enjoying the water outside the boat.

While passengers may want to go in the water, some do not go in the water or limit their time in the water so as to avoid overexposure to the sun while in the water. In fact, many would enjoy the water more if they could relax and float in the water under the comfort of shade. Moreover, a boat shade that extended over the water would be welcomed by parents or caretakers of small children that are susceptible to sunburn. Unfortunately, there are no extendable boat shades known that effectively or adequately extend outside the perimeter of the boat for shading the surrounding water and that retracted when no longer desired or required. If there existed an extendable boat shade device that extended over the water in a manner that provided the shade over the surrounding water as desired and retracted when not needed, it would be well received.

Another problem with boaters, is breaking down or getting lost at sea. When this occurs, planes or helicopters are sent out to search the waters for the missing boat. Given the vastness of the ocean, it can be difficult to locate a stranded or missing boat. Accordingly, if there existed a boat shade device that could also serve as an enlarged target for identifying a stranded or lost boat, it could save lives or time in saving lives and would be well received.

As there are no known extendable and retractable boat shade devices that can be extended out over the surrounding water of a boat to provide shade as desired for occupants in the water and retracted when no longer needed or desired while also providing a conspicuous target for locating and identifying lost or stranded boats, there exists a need for such an extendable and retractable boat shade device. It is therefore desirable to have an extendable and retractable boat awning that could be conveniently mounted to an existing boat roof top or tower and would extend out over the surrounding water of the boat in a manner that effectively and adequately provided shade to occupants in the water around the boat while providing a conspicuous target in the event of an emergency. If there existed such an extendable and retractable boat awning it would address the shortcomings in the background art and be well received. As there are no such boat awning devices known, there exists a need for such a device. It is, therefore, to the effective resolution of the aforementioned problems and shortcomings of the prior art that the present invention is directed. The instant invention addresses this unfulfilled need in the prior art by providing an extendable and retractable boat awning as contemplated by the instant invention disclosed.

SUMMARY OF THE INVENTION

In the present invention, these purposes, as well as others which will be apparent, are achieved generally by providing a boat awning device and system.

It is also an object of the instant invention to provide a boat awning device that selectively provides shade over the water on at least one side of a boat.

It is another object of the instant invention to provide a boat awning device and system that selectively provides shade over the water on the starboard and port sides of the boat.

It is an additional object of the instant invention to a boat awning device and system for providing shade over the water around the boat that is convenient and cost-effective to make and install.

In accordance with one aspect, the present invention provides an extendable and retractable boat awning device that is mountable on at least one side of a boat to a boat roof top so that when the awning device is opened it allows people in the water to swim or float in shade outside the boat and is retractable when it is no longer needed, or the boat is preparing to move.

In another aspect, the present invention provides a boat awning device or system that generally includes a canopy assembly and a support base that is mountable to the roof of a boat wherein the canopy assembly is pivotally attached at one end to the support base by a plurality of pivoting support rods that support and extend a flexible canopy and the support base includes an encasement, encasement cover, a plurality of base mounting assemblies each having a mounting beam extending from a ceiling mounting plate wherein the ceiling mounting plate is mountable to a boat roof for supporting the boat awning device on the boat and that may be easily removed from the boat roof.

In an additional aspect, the present invention provides a boat awning system that generally includes a canopy assembly and a support base that is mountable to the roof of a boat wherein the canopy assembly includes an encasement supporting and housing a plurality of support arms that are pivotally connected at one end in the encasement with each support arm having a canopy support rod extending from the support arm, a flexible canopy mounted to the support rods for extending and retracting the canopy, support arm locking mechanism for locking the support arms in an opened position when extending outside the encasement and in a closed position when retracted into the encasement, and a plurality of base mounting assemblies each having a mounting beam extending from a ceiling mounting plate wherein the ceiling mounting plate is mountable to a boat roof for supporting the boat awning device on the boat. The canopy may be or have a reflective material or easily visible color, such as bright yellow or orange, on its top surface for easier visibility in the event the boat is stranded out at sea.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
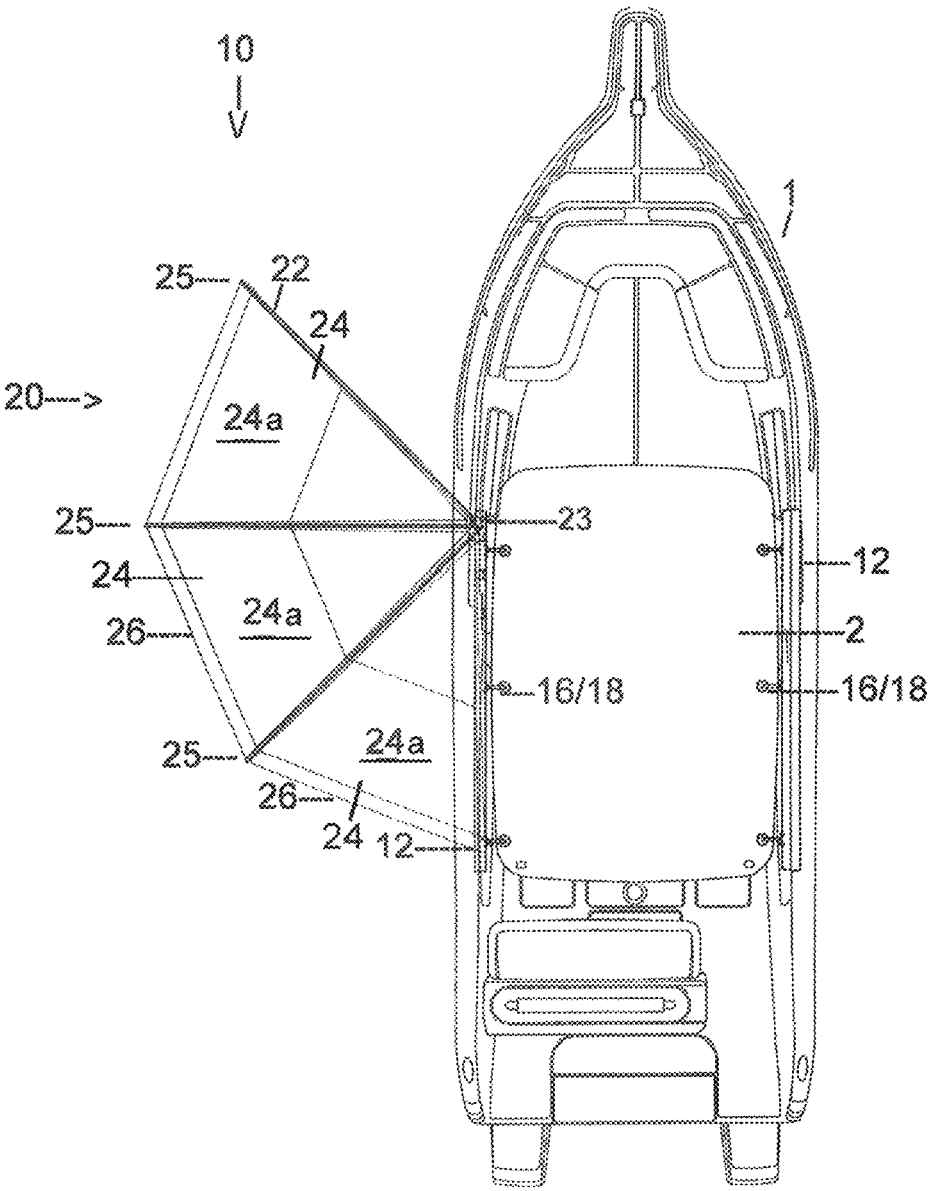
FIG. 1 is a plan elevational view of the boat awning device mounted to one side of a boat roof top in an opened position and another boat awning device mounted to an opposite side of the boat roof top in a closed position in accordance with the principles of the present invention.
Figure 2:
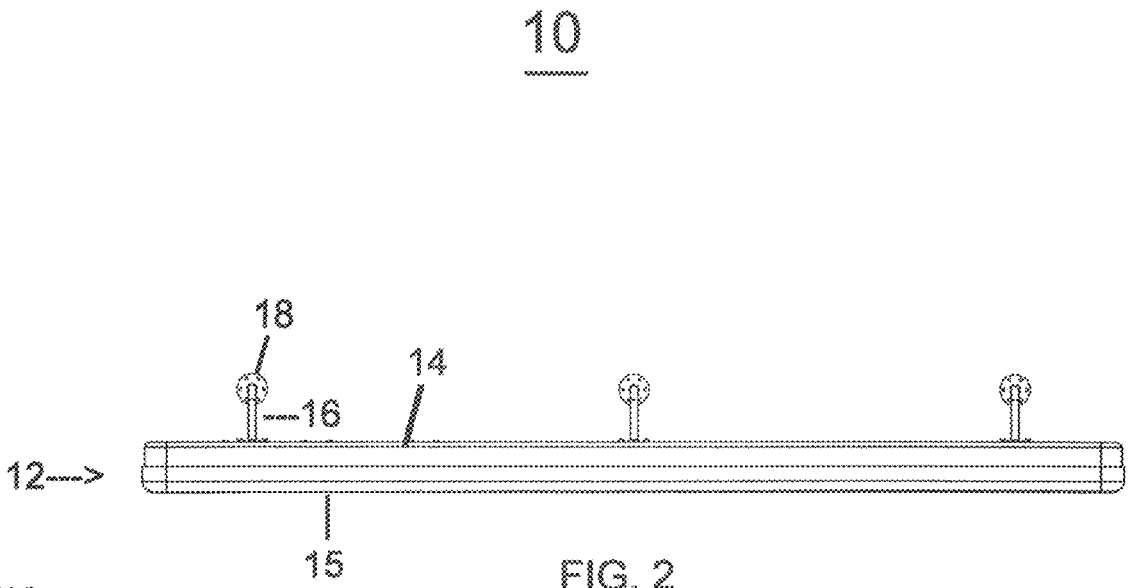
FIG. 2 is a plan elevational view of the boat awning device shown in FIG. 1 in a closed position in accordance with the instant invention.
Figure 3:
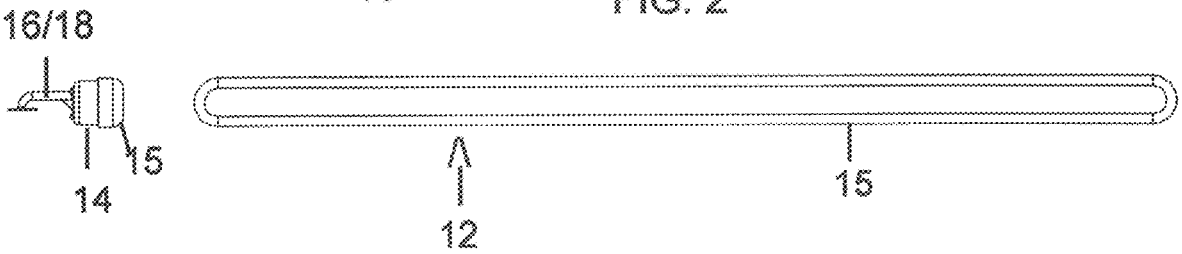
FIG. 3 is a side elevational view of the boat awning device shown in FIG. 1 in a closed position in accordance with the instant invention.

With reference to the drawings in which like reference designators refer to like elements, FIGS. 1 to 26 depict the preferred and alternative embodiments of the instant invention, which is generally referenced as a boat awning, awning and, or by numeric character 10. There is shown in FIGS. 1-26 an extendable and retractable boat awning device 10. With reference to FIG. 1, the boat awning device 10 includes a canopy 24 that is mounted on the port side of a boat 1, such as to a boat roof top 2, by a support base 12 and is shown in an opened position, while a second boat awning device 10 is mounted on the starboard side of the boat to the opposite side of the boat roof top 2 with the canopy 24 shown in a closed position. When canopy 24 is extended into an opened position it allows people in the water to swim or float in shade outside the boat to be protected from UV rays and may be used on boats or yachts. The canopy 24 is retracted when it is no longer needed. The canopy 24 is a flexible substrate of preferably waterproof and sunproof stretch canvas textile material that may be made from canvas, vinyl, acrylic, cloth, fabric, synthetic, polyester, or other materials known in the art for outdoor canopies or umbrellas The size of the boat awning device 10 may vary with the size of the boat 1. The canopy 24 may be or have a reflective material or easily visible color, such as bright yellow or orange, on its top surface 24*a* for easier visibility in the event the boat is stranded out at sea.

Figure 18:
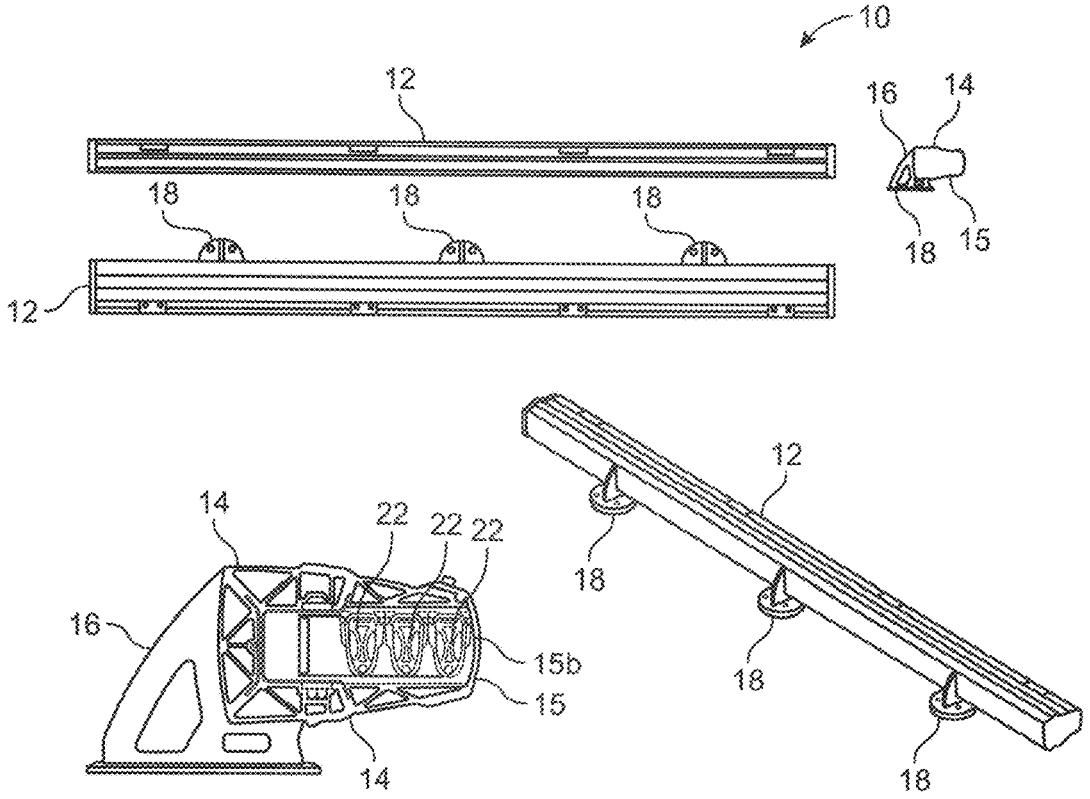
FIG. 18 are elevational and partial cross-sectional views of the mounting base assembly and support base of the boat awning device in accordance with the instant invention.
Figure 19:
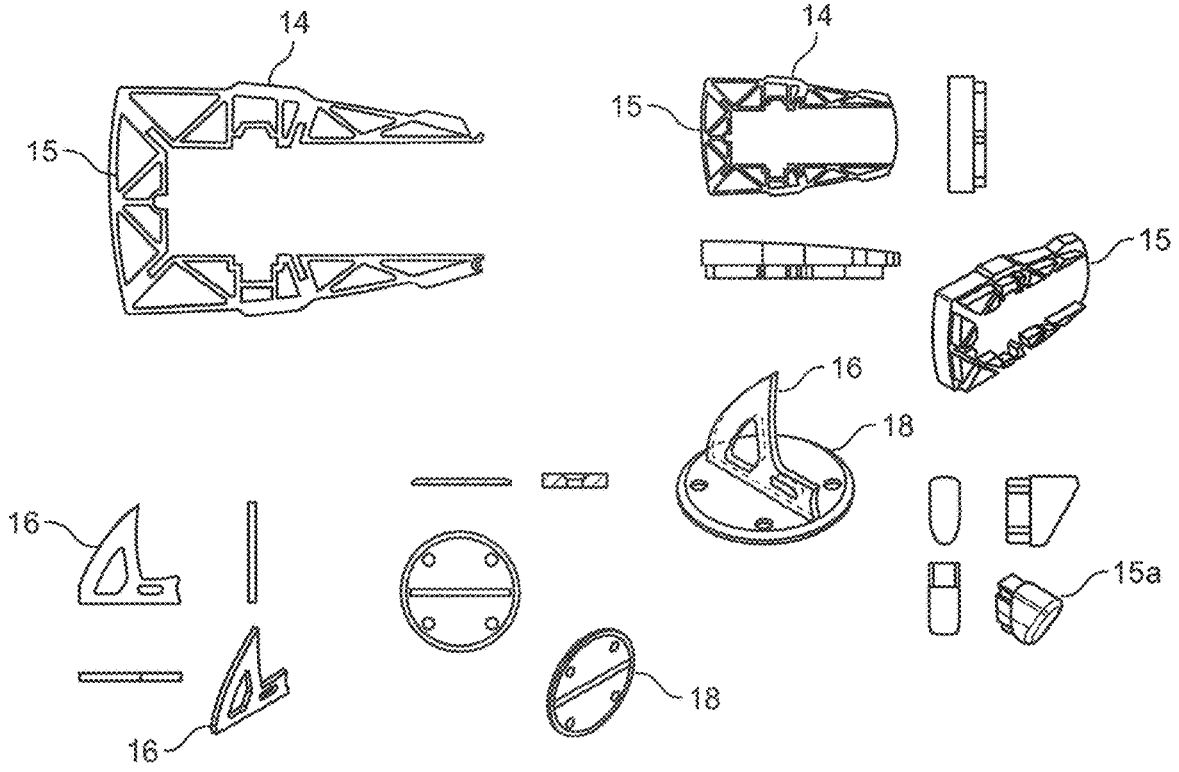
FIG. 19 is a side elevational view of the boat awning device shown in FIG. 1 in a closed position in accordance with the instant invention.
Figure 20:
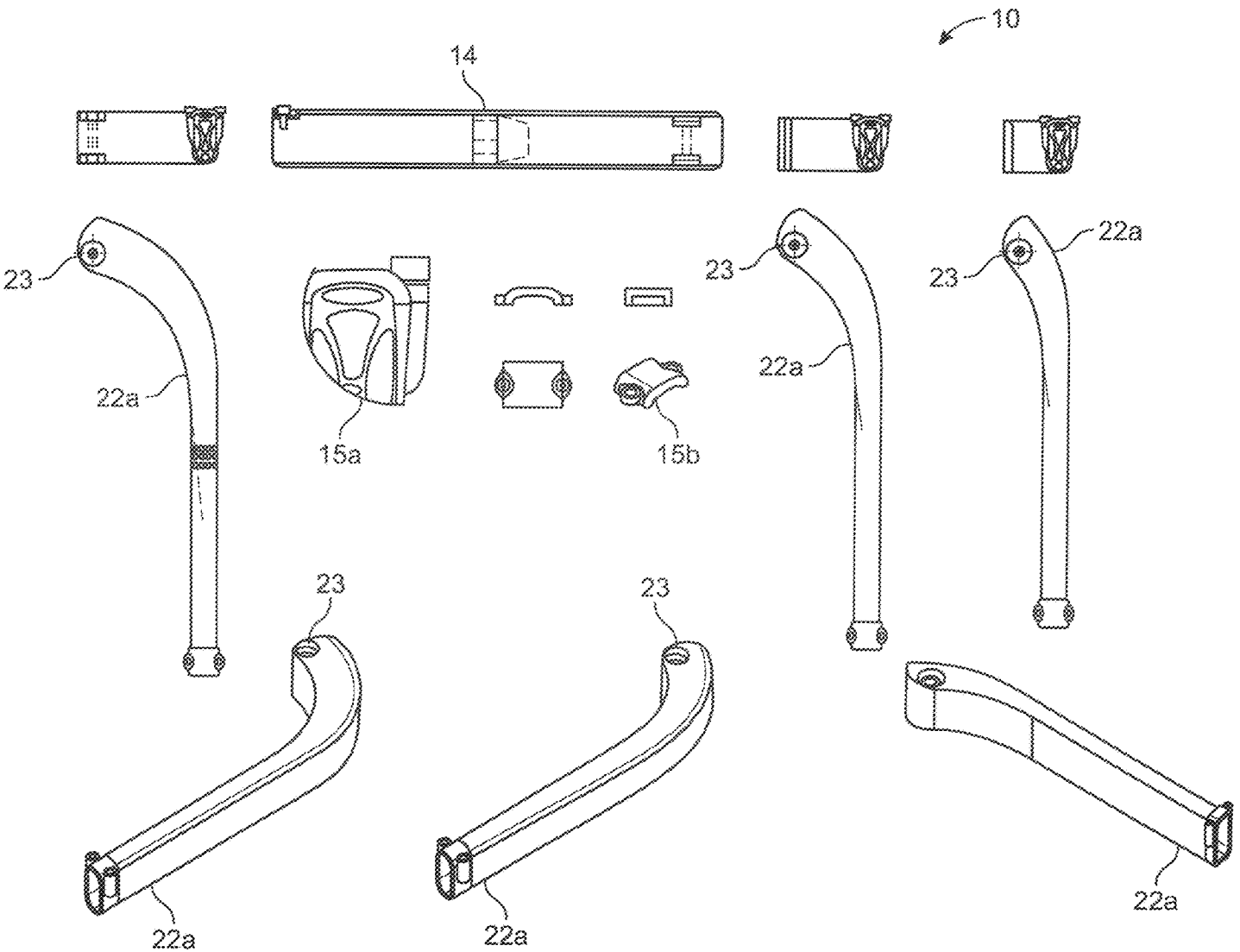
FIG. 20 is an exploded view of the support base of the boat awning device in accordance with the instant invention.
Figure 21:
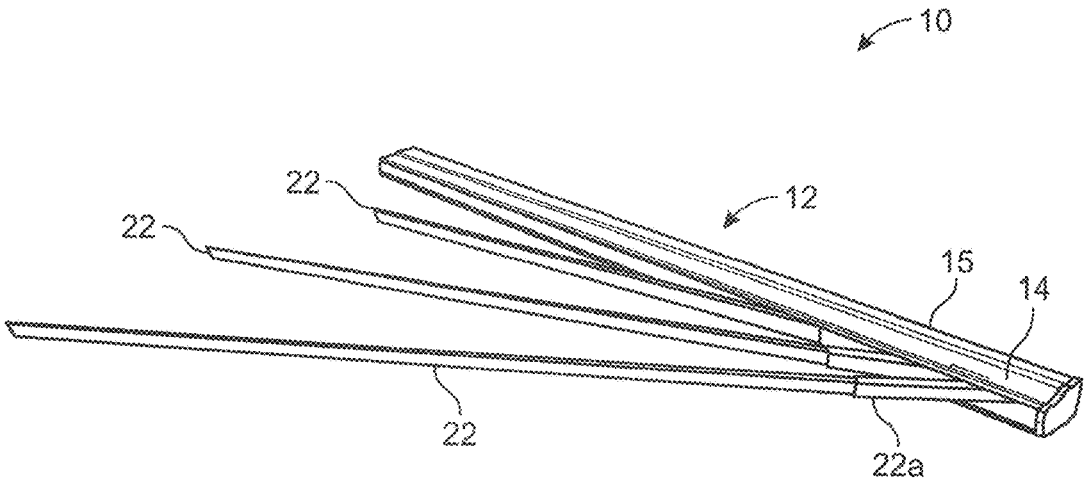
FIG. 21 is a first elevational view of the support base of boat awning device in a partially opened position in accordance with the instant invention.
Figure 22:
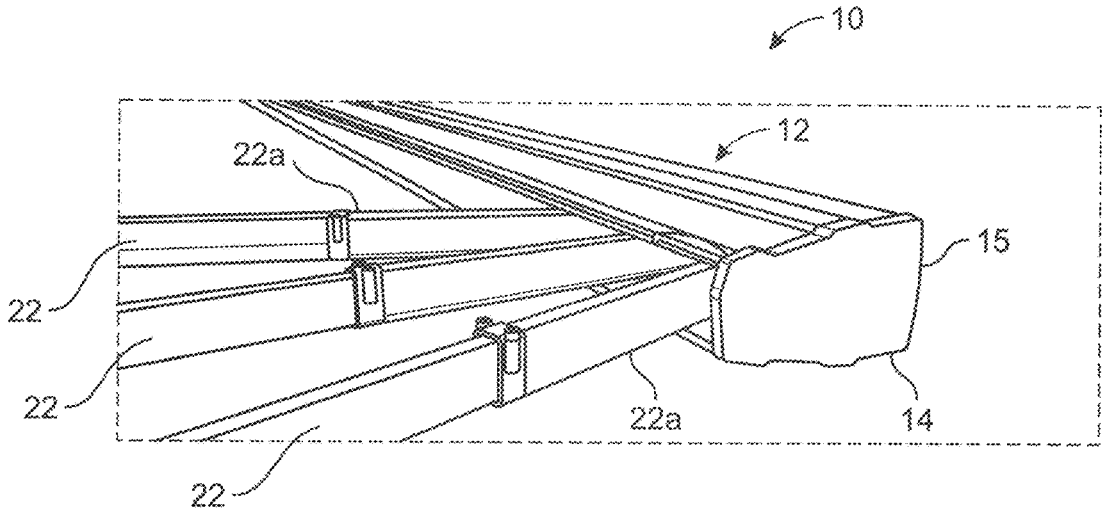
FIG. 22 is a second elevational view of the support base of boat awning device in a partially opened position in accordance with the instant invention.
Figure 23:
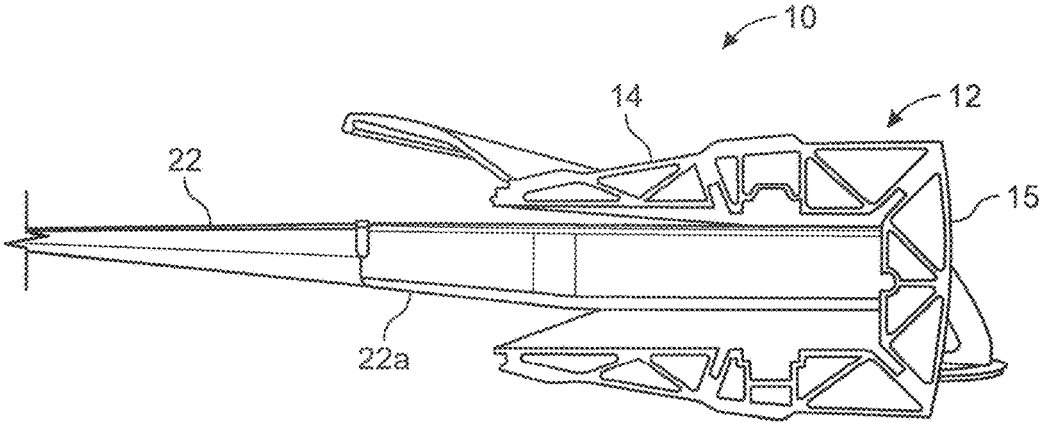
FIG. 23 is bottom elevational view of the support base of boat awning device in accordance with the instant invention.

With reference to FIGS. 1-7, 18 and 19, the boat awning device 10 generally includes a canopy assembly 20 and a support base 12 wherein the canopy assembly 20 is pivotally attached at one end to a support base 12. The support base 12 includes an encasement 14, encasement cover 15, and a plurality of base mounting assemblies 6/18 each having a mounting beam 16 extending from a ceiling mounting plate 18. The mounting beams 16 are affixed to the encasement 14 by fasteners 21. The ceiling mounting plate 18 is joined, connected, or integrally formed to a free end of the mounting beams 16. The mounting beams 16 have an arcuate outer edge so as to not cause damage or injury and extend and bend from the ceiling plate 18 at approximately ninety degrees (90°) or other desired angle so that the mounting plate 18 can align flush with the boat roof top or tower 2 for securely mounting the support base 12. The ceiling mounting plate 18 defines a plurality of fastener apertures 19 for receiving fasteners used to secure the support base 12 to a desired surface to facilitate use of the canopy assembly 20. The preferred structure of the mounting beams 16 and ceiling mounting plate 18 are best shown in FIGS. 18-19.

Figure 4:
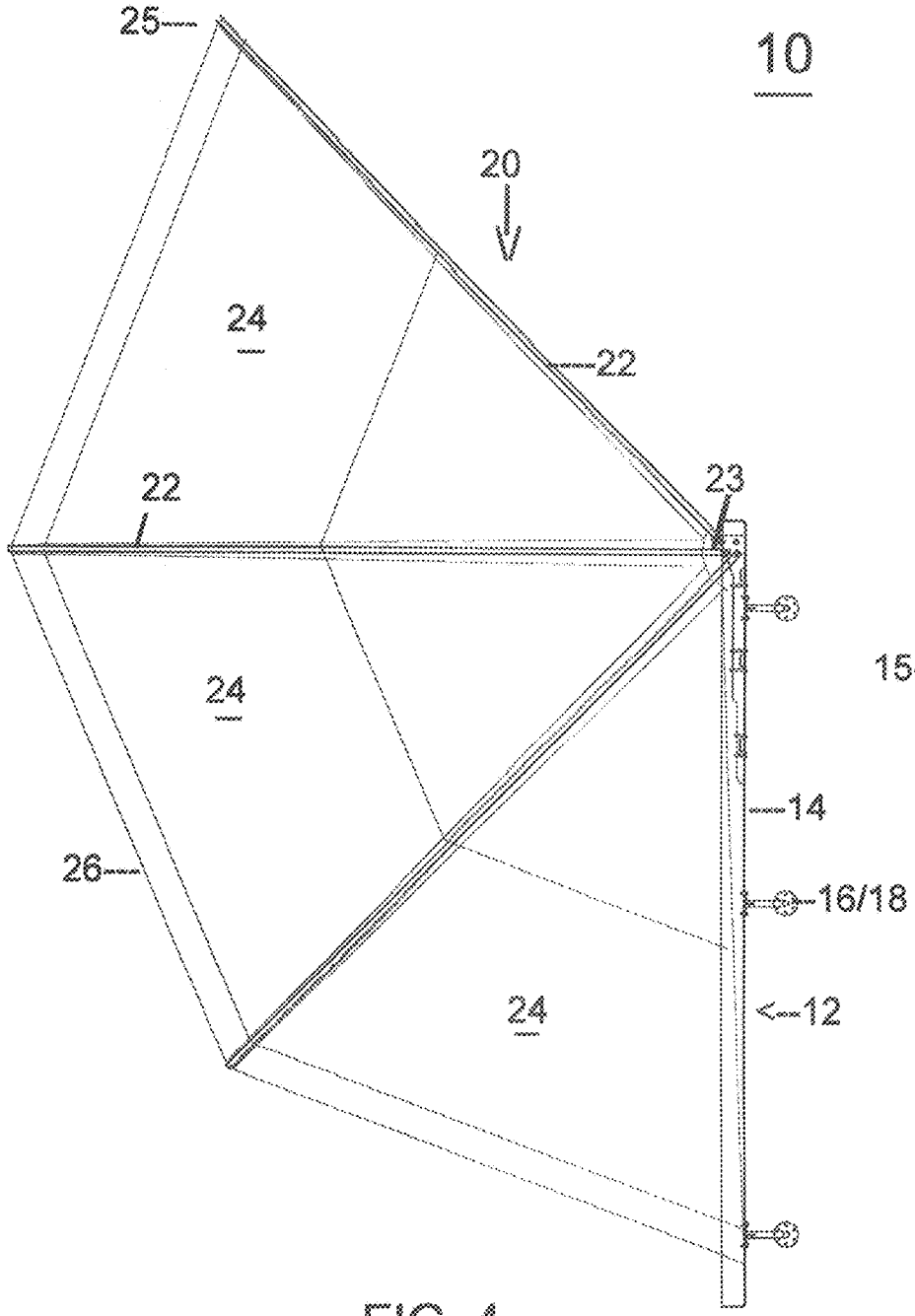
FIG. 4 is a plan elevational view of the boat awning device shown in FIG. 1 in an opened position in accordance with the instant invention.
Figure 5:
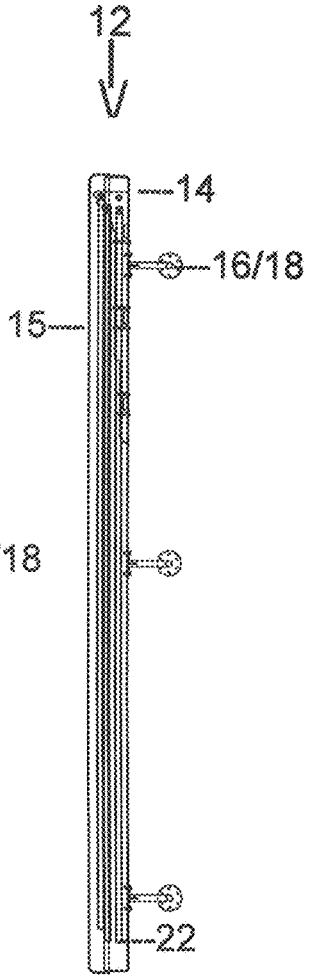
FIG. 5 is a side elevational view of the boat awning device shown in FIG. 1 in a closed position in accordance with the instant invention.
Figure 6:
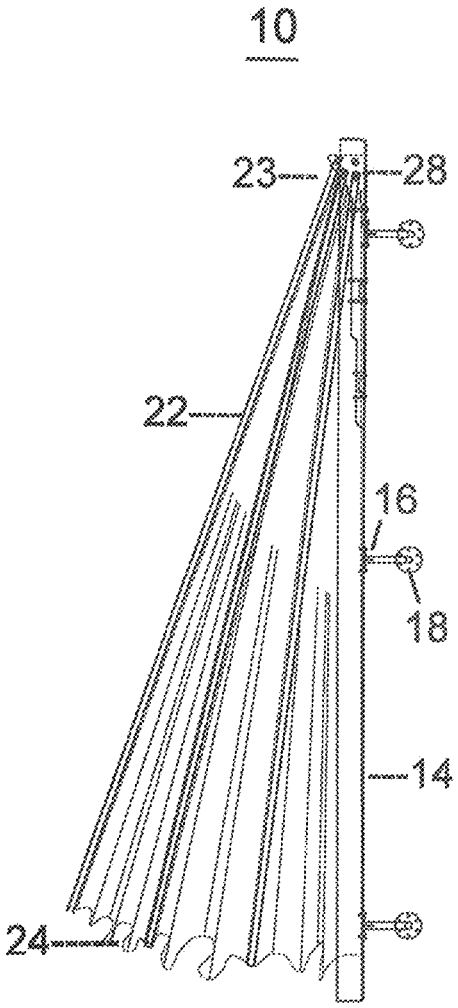
FIG. 6 is a plan elevational view of the boat awning device shown in FIG. 1 in a partially opened position in accordance with the instant invention.
Figure 7:
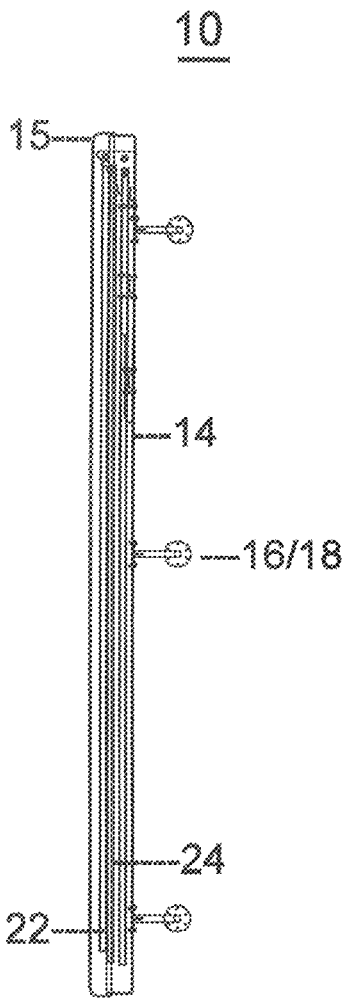
FIG. 7 is a side elevational view of the boat awning device shown in FIG. 1 in a closed position in accordance with the instant invention.
Figure 8:
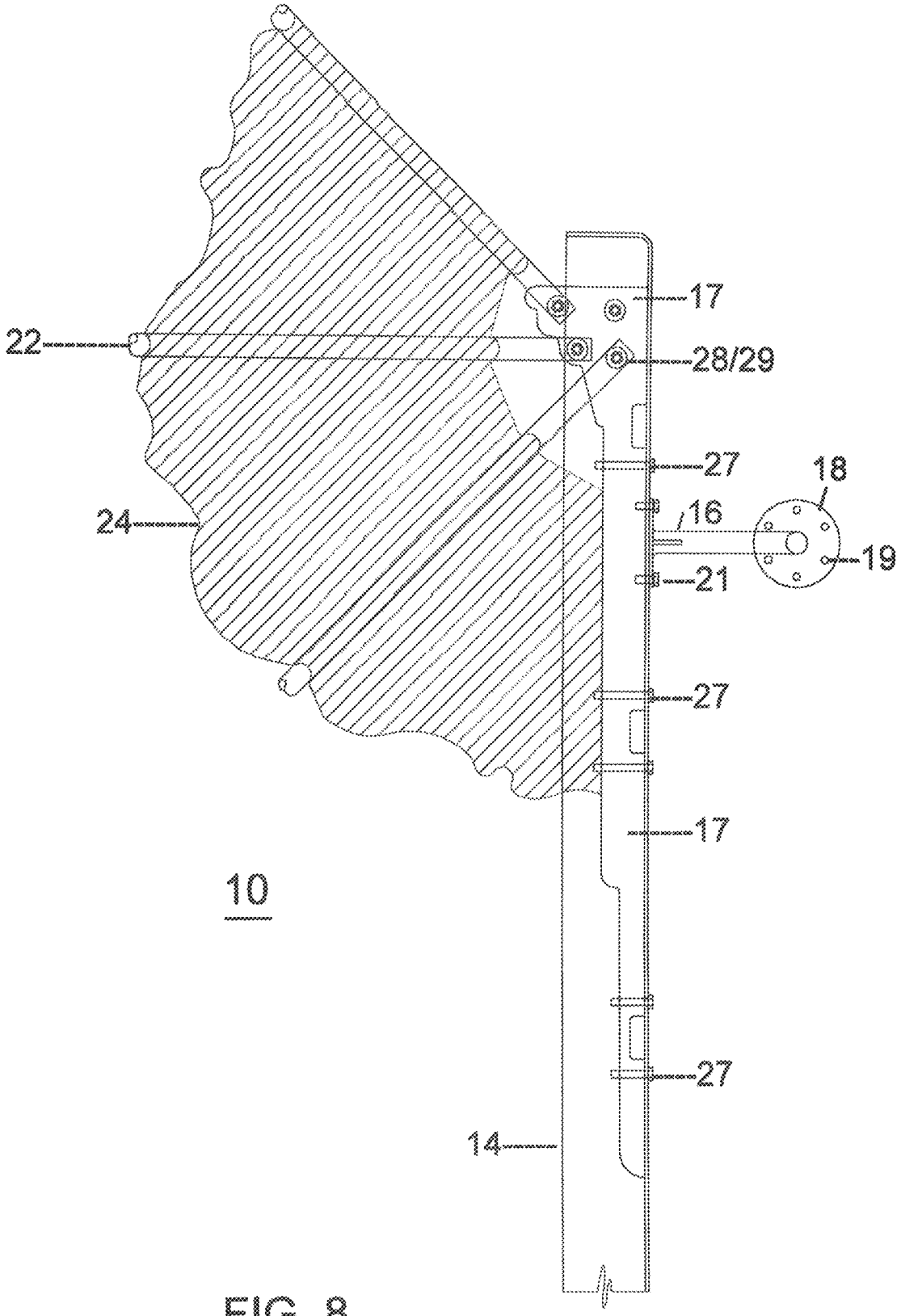
FIG. 8 is a partial cross sectional view of the boat awning device shown in FIG. 1 in an opened position in accordance with the instant invention.
Figure 9:
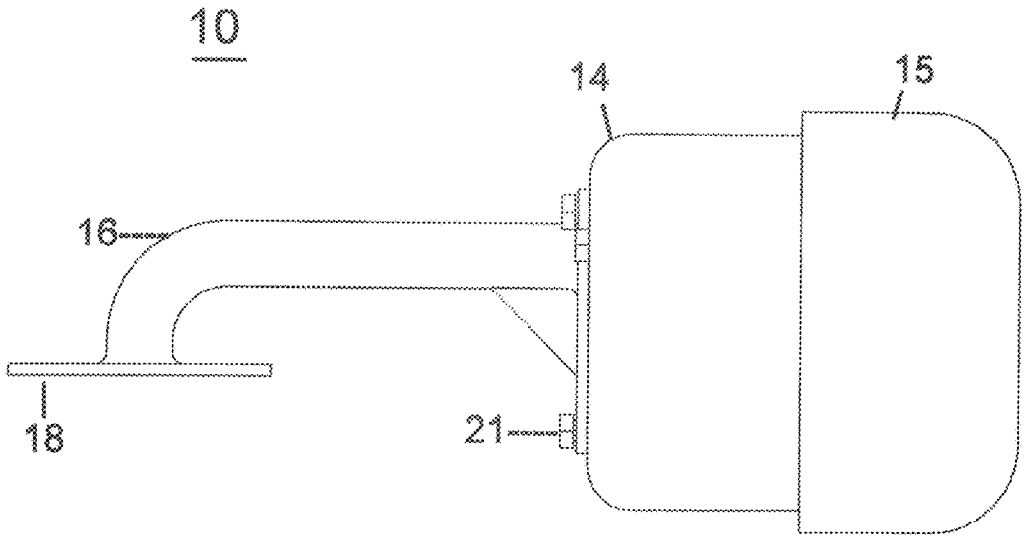
FIG. 9 is an end elevational view of the boat awning device shown in FIG. 1 in accordance with the instant invention.
Figure 10:
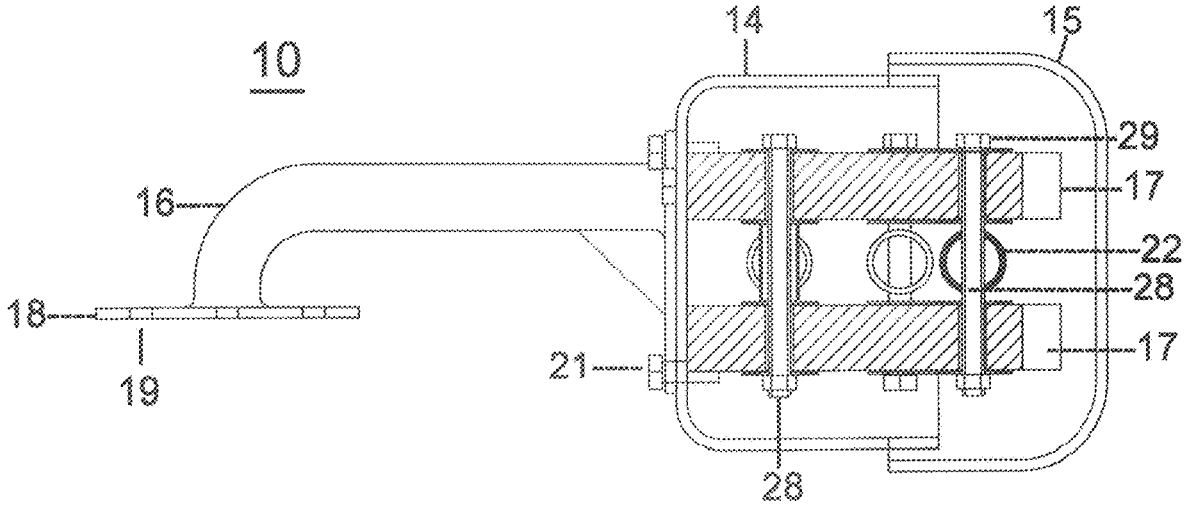
FIG. 10 is a partial cross sectional end view of the boat awning device shown in FIG. 1 in a closed position in accordance with the instant invention.
Figure 11:
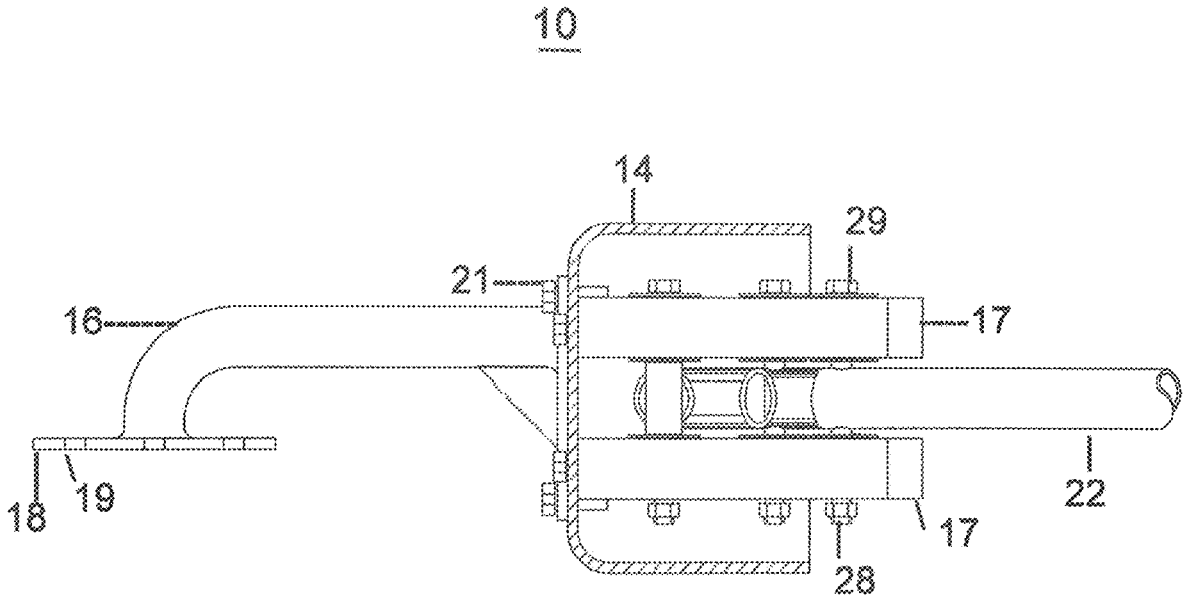
FIG. 11 is a partial cross sectional end view of the boat awning device shown in FIG. 1 in an opened position in accordance with the instant invention.
Figure 12:
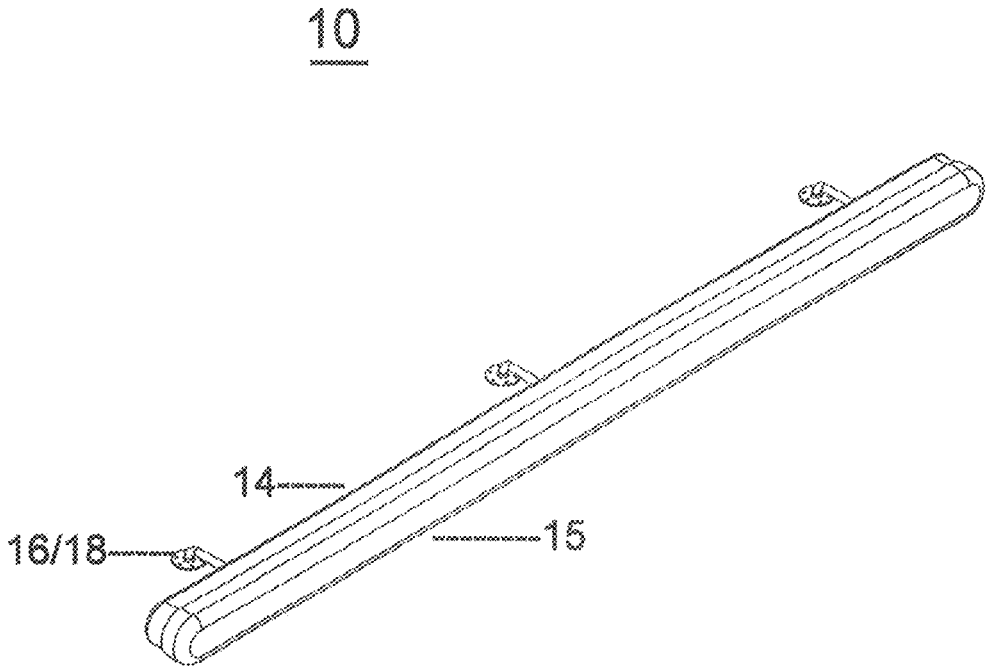
FIG. 12 is a plan elevational view of the boat awning device shown in FIG. 1 in a closed position in accordance with the instant invention.
Figure 13:
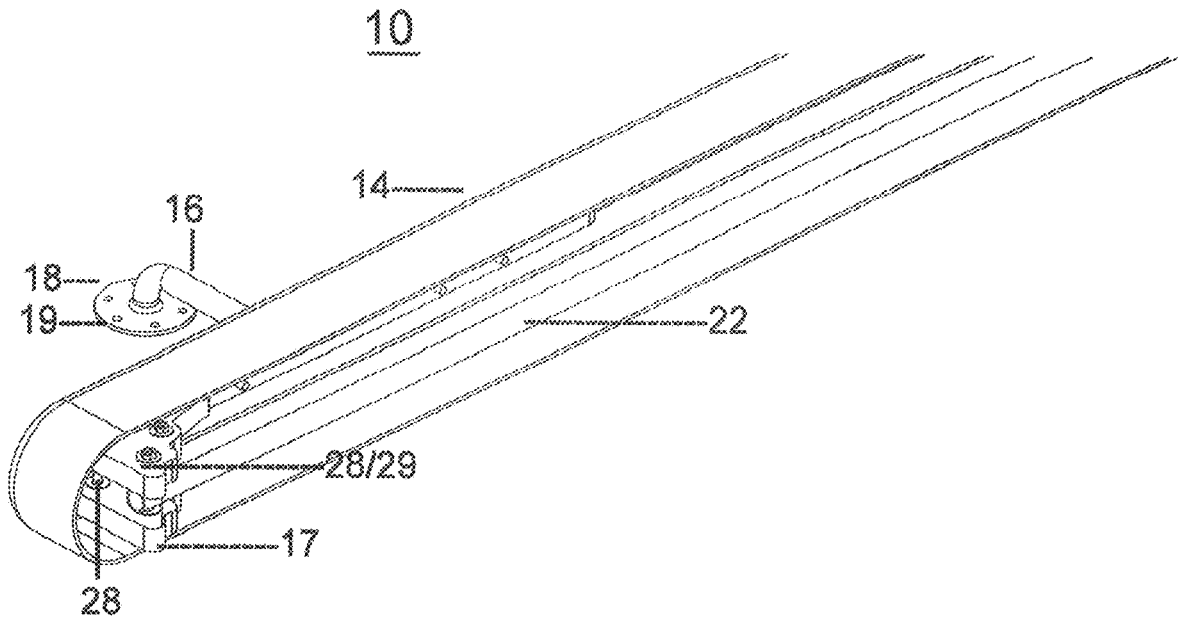
FIG. 13 is a side elevational view of the boat awning device shown in FIG. 1 showing inside the boat awning device in accordance with the instant invention.
Figure 14:
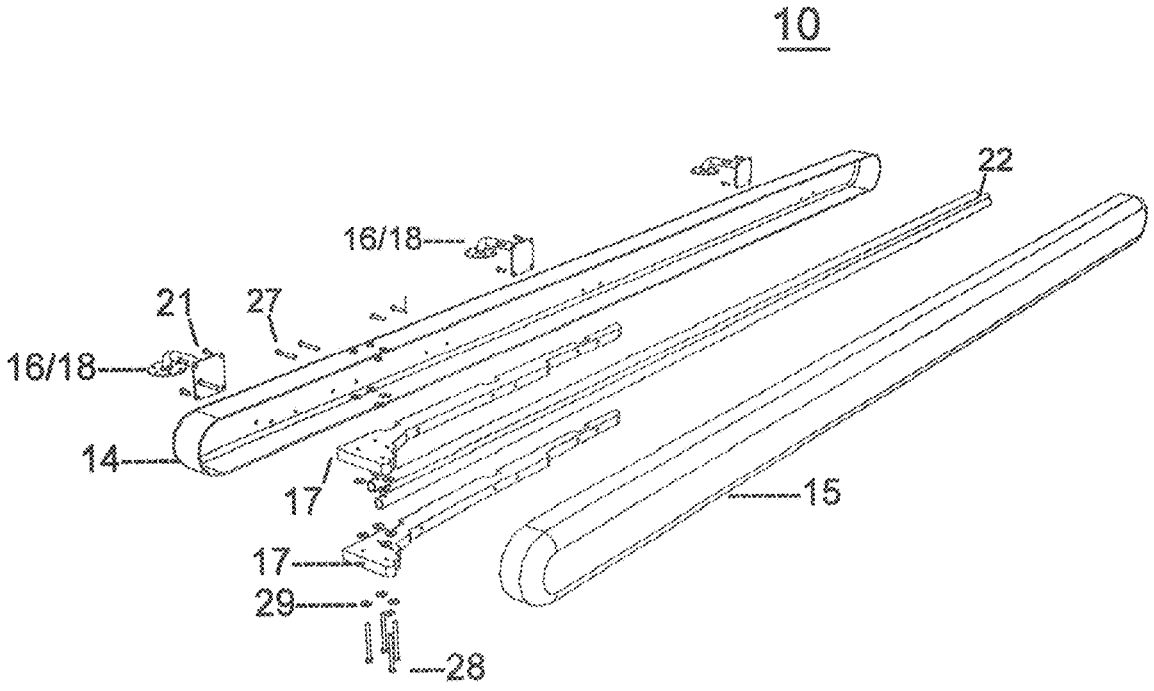
FIG. 14 is an exploded view of the boat awning device shown in FIG. 1 in accordance with the instant invention.
Figure 16:
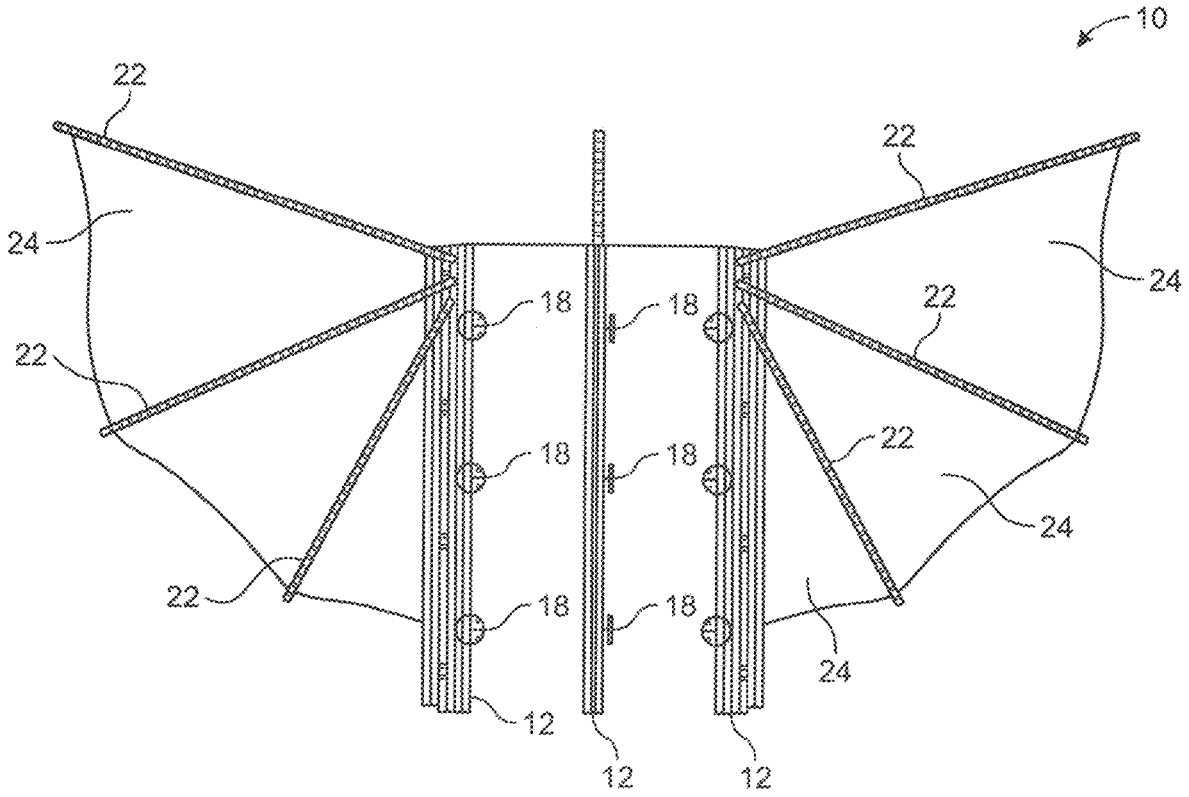
FIG. 16 is a plan elevational view of the boat awning device showing two boat awning devices for both the port and starboard sides of a boat in accordance with the instant invention.
Figure 17:
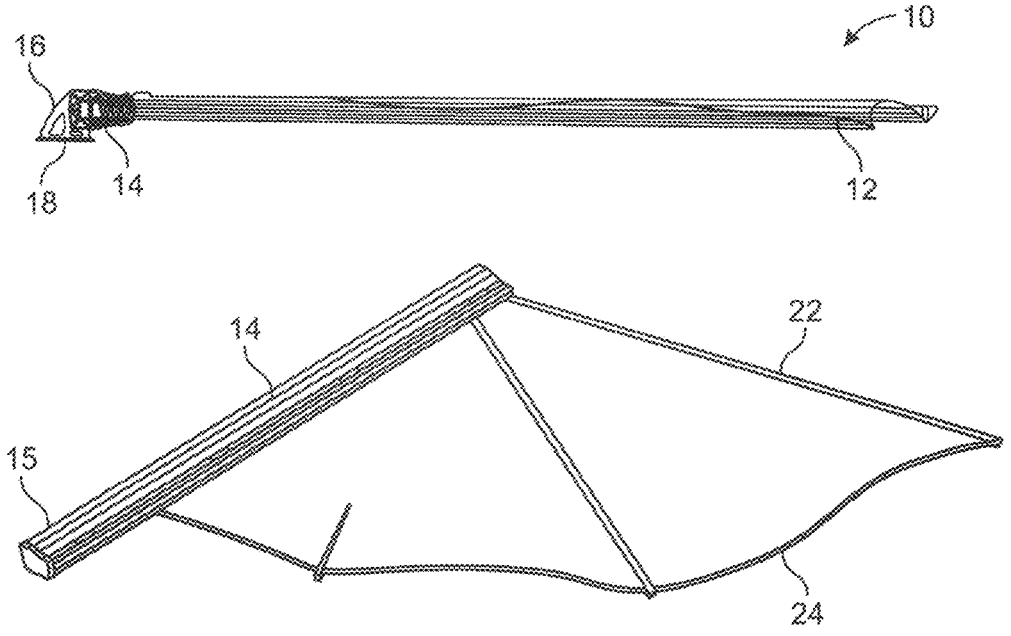
FIG. 17 is a plan elevational view of the boat awning device showing the canopy assembly and support base in accordance with the instant invention.

Still referring to FIGS. 1-7 and 18-23, the canopy assembly 20 includes a plurality of support rods 22 having a fixed end 23 and free end 25 and at least one fabric material or canvas 24 mounted to or over the rods 22 for supporting, extending, and retracting the canvas 24, as shown in FIG. 4. The support rods 22 are preferably made from a rigid or semi-rigid material, such as anodized or painted aluminum, ABS plastic, PVC, plastic, or other awning rod material known in the art, that may be slightly flexible such that it withstands strong winds without breaking. The support rods 22 are supported in the encasement support arms 22*a* and provide support while acting as stretchers for expanding the canvas 24. The fixed or pivot ends 23 of the support arms 22*a* and rods 22 are pivotally mounted to a hinge 28 at the first end of the encasement 14 and the free ends 25 are connected or joined to an outside edge of the canvas 24, which may define a hem 26 for stability. An inner side edge of the canvas 24 is secured to the encasement 14 to facilitate stretching the canvas 24 when the support rods 22 are pivoted outward to extend the canvas 24, as shown in FIGS. 4 and 16, as well as retracting the canvas 24 into the encasement 14 when the support rods 22 are pivoted inward toward the encasement 14, as shown in FIGS. 6 and 17. When the canvas 24 and rods 22 are retracted into the encasement 14 they are fully enclosed in the encasement for storage and protection from ambient elements, as shown in FIGS. 5, 7 and 21-23. The canvas 24 may comprise a single panel or a plurality of individual panels 24 secured to the support rods 22. The canvas 24 may include medial pleats extending laterally across the canvas 24 between adjacent rods 22 so as to bridge the rods 22 and, or longitudinally along the canvas 24 from the fixed ends 23 and free ends 25 of the rods 22, as shown in FIGS. 4, 6, 16 and, 17.

With further reference to FIGS. 1-14 and 18-23, and in particular to FIGS. 8-23, the support base 12 further comprises at least one or preferably two support flanges 17 secured in the encasement 14. The support flanges 17 or preferably secured substantially in parallel in the encasement 14. The support flanges 17 have an enlarged contoured end for attaching the fixed ends 23 to the pivot hinges 28 and aligning and spacing the rods 22 in a way that facilitates extending and folding the rods 22 into the encasement without obstruction between the rods 22 when pivoting them. The pivot or fixed ends 23 of the support arms 22*a* for the rods 22 are each secured to a pivot hinge 28 wherein each pivot hinge 28 includes a pin which passes through an aperture defined in the fixed end 23 of the rod 22 and may be secured to the support flange 17 by a fastener 29. The support flange 17 is secured in and, or to the encasement 14 by flange fasteners 27. The encasement 14 and support flanges 17 and other components in the encasement are enclosed by an encasement cover 15 that mounts to or sealing engages the opening of the encasement through which the components are placed. In an alternative embodiment, the fasteners 21 and, or 27 may be replaced with rivets, adhesives and, or other known connectors or fasteners.

Referring to FIGS. 1-26, the boat awning device 10 is preferably made from materials that are water proof, seawater proof and, or corrosion proof and pliable for giving to wind conditions without breaking or failing. The rods 22, encasement 14, encasement cover 15 and, or support flanges 17 are preferably made from fiberglass but may also be made from PVC, plastic material, aluminum, or stainless steel. The fasteners 21, 27 and, or hinge pin 28 are preferably made from stainless steel or corrosion proof metals but may also be made from aluminum, PVC, plastic, or fiberglass. The canvas 24 may be made from nylon, polyester, pongee, polyester satin, or other known material that is flexible and seawater proof as well as resistant to strong wind forces without ripping. The canvas top surface 24*a* preferably has a UV coating and or may have an easily visible color, such as bright yellow or orange, on its top surface 24*a* for easier visibility in the event the boat is stranded out at sea.

Figure 15:
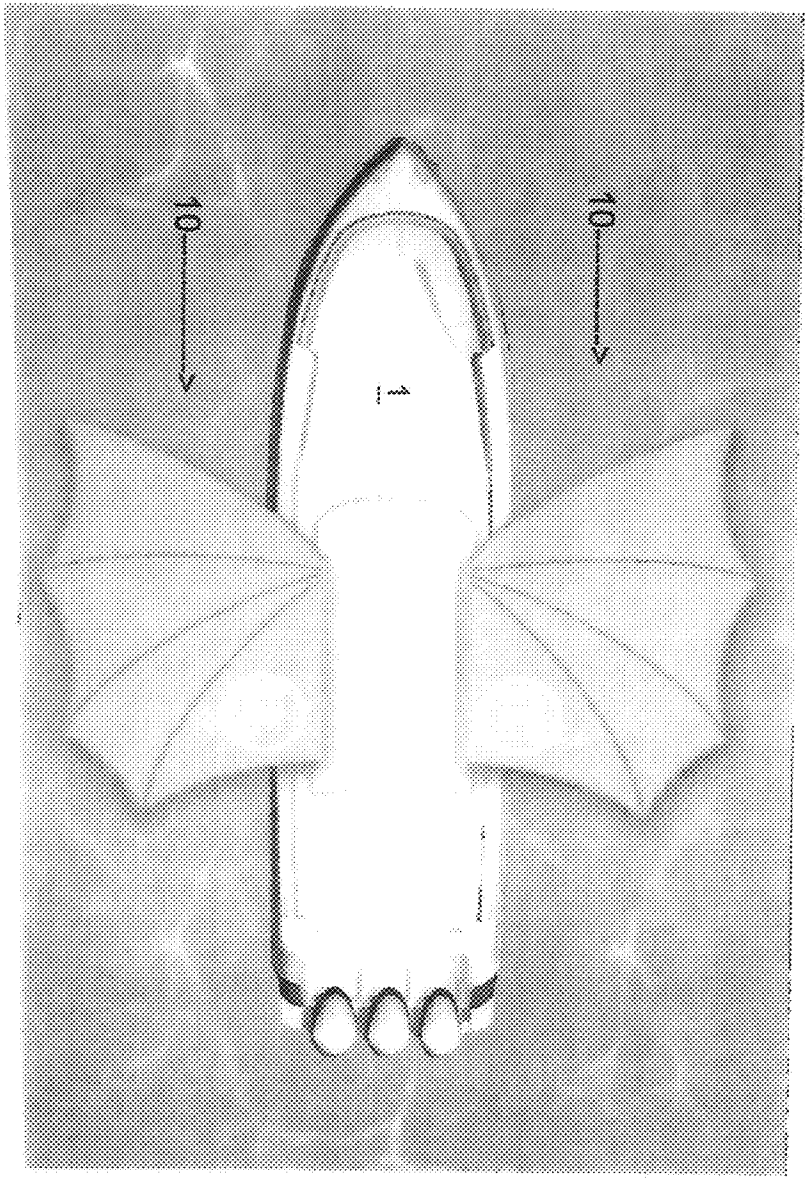
FIG. 15 is a plan illustrated view of the boat awning device in an opened position in accordance with the instant invention.

Now referring to FIG. 15, the boat awning device 10 is shown on the starboard and port sides of a boat. This embodiment of the instant invention 10 shows that the rods 22 and, or canvas 24 may be curved or have curved edges for aesthetic appeal. Accordingly, the aesthetic look and appeal may vary without departing from the structural scope and spirit of the instant invention. In addition, the boat awning device 10 can serve as a conspicuous target for identifying and locating the boat 1 in the event it becomes stranded. In fact, in addition to the UV coating, the awning device 10 could be coated with a reflective coating for enhanced visibility.

Figure 24:
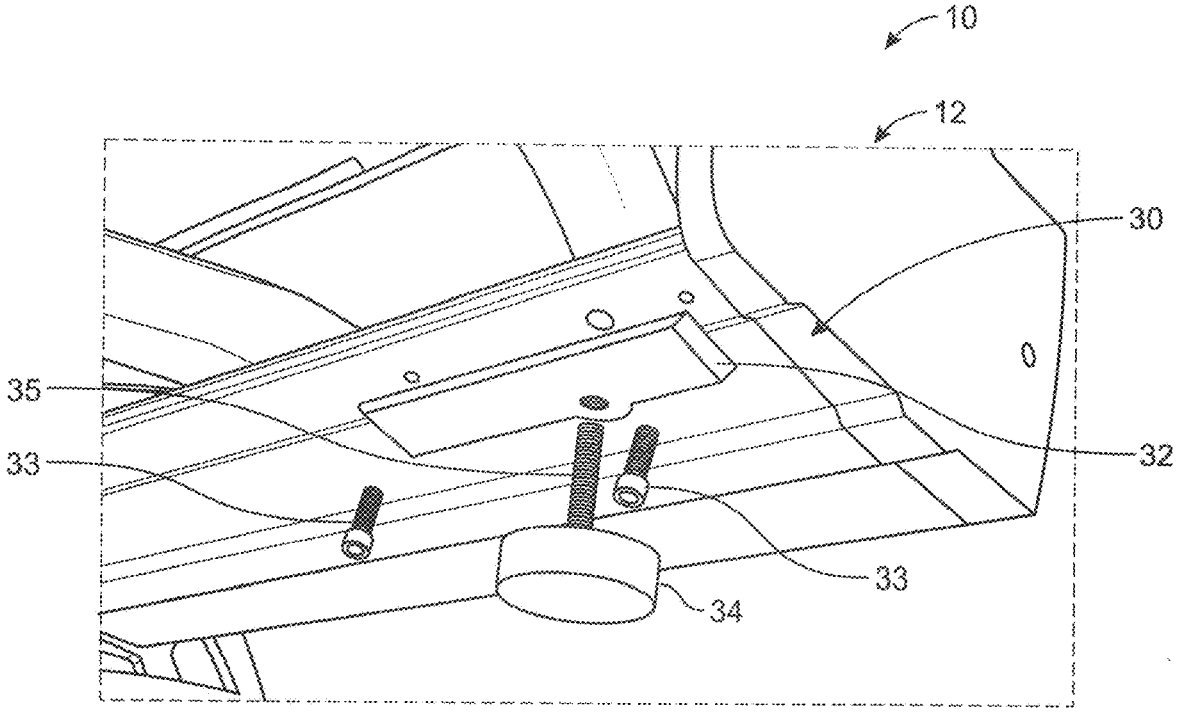
FIG. 24 is a bottom elevational view of the support base of the boat awning device showing the support arm locking mechanism in an exploded view or unlocked position in accordance with the instant invention.
Figure 25:
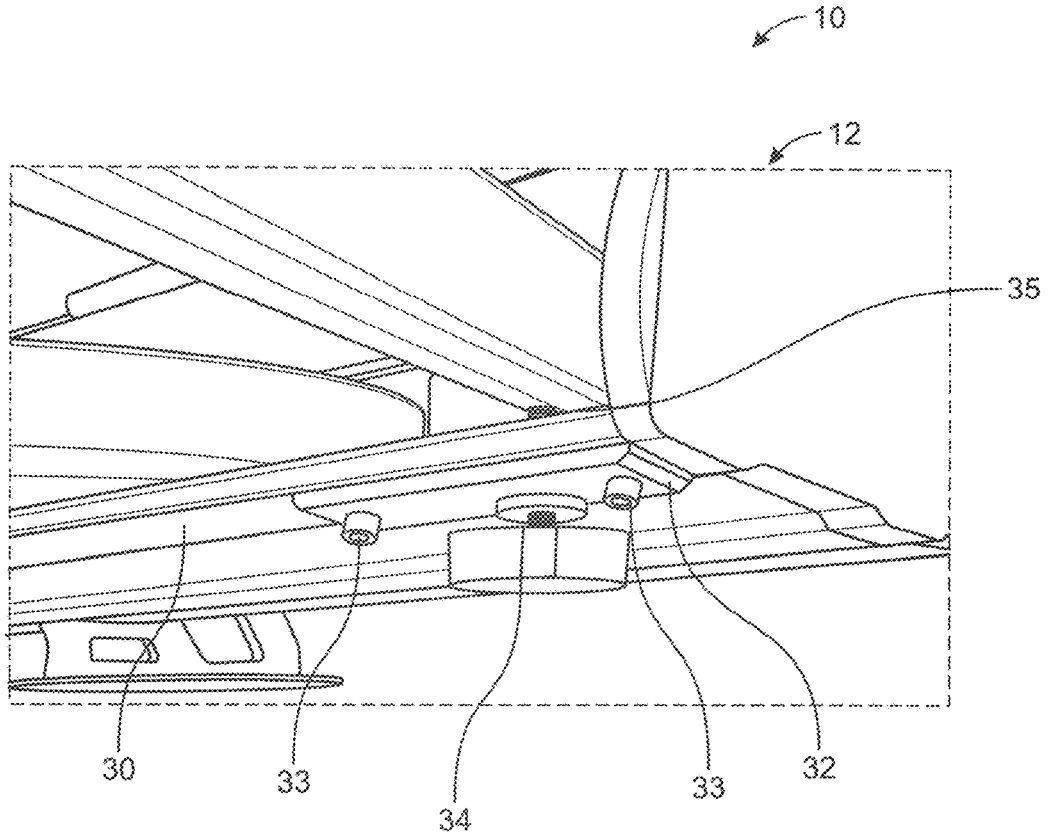
FIG. 25 is a bottom elevational view of the support base of the boat awning device showing the support arm locking mechanism in a locked position in accordance with the instant invention.

With reference now to FIGS. 16-26, the boat awning device and system 10 of the instant invention 10 is designed with an awning device 10 for the port and starboard sides of the boat 1. The boat awning device 10 preferably has three support rods 22 pivotally mounted to the support base 12 which is mounted to the mounting beam assembly 16/18 to the beam 16 on the ceiling mounting base 18 which is mounted to the boat roof 1. The beam 16 extends substantially perpendicularly from the ceiling mounting base 18 and has a curved outer edge to avoid injury to a person or damage to the canopy 24. The three support rods 22 support and secure the canopy 24 when extended and retracted from the support base 12. The support rods 22 are pivoted outward to extend the canopy 24 over the water and retracted inward into the base 12 when not in use. With reference to FIGS. 24 and 25, the awning device and system 10 may include a support arm locking mechanism 30 that locks the support arms and rods 22*a*/22 in an opened position when extended outside the encasement 14 and in a closed position when retracted into the encasement 14. The support arm locking mechanism 30 may include a support plate 32 mounted with fasteners 33 to the encasement 14 and a knob 34 at one end of a threaded bolt 35 that is threaded through a corresponding threaded nut or opening in the plate 32 at the free end of the bolt 35 to lock or unlock the support arms 22*a* and or rods 22, as shown in FIGS. 24 and 25. The support rods 22 are mounted to or in the support arms 22*a* which are pivotally supported in the encasement 14 which is sealed off for protection by a side cover 15 and finish profile 15*a*.

Figure 26:
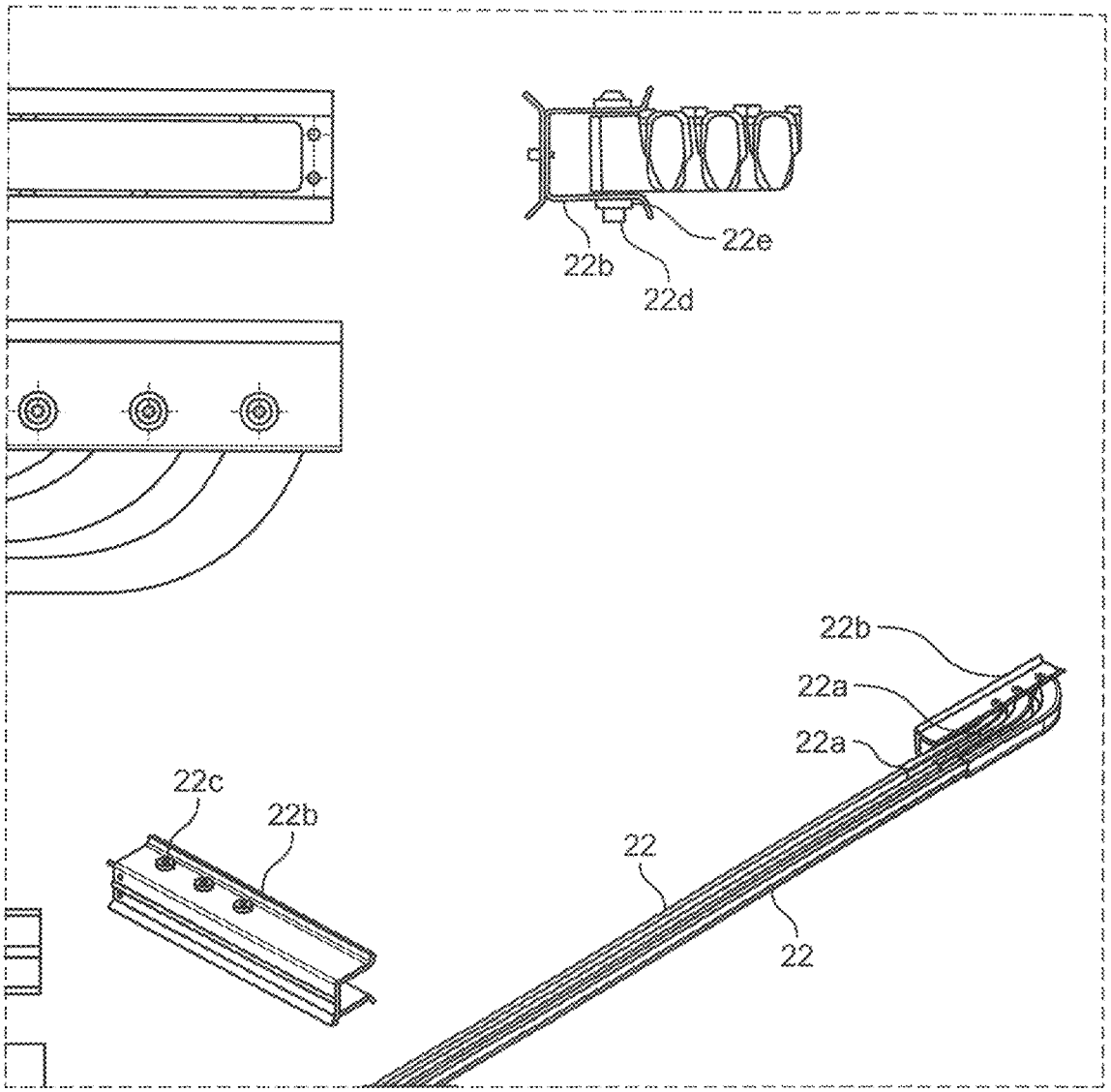
FIG. 26 are perspective and side elevational views of the pivoting U-bracket of the boat awning device showing it with and without the support rods and arms installed in accordance with the instant invention.

Referring to FIG. 26, the fixed ends 23 of the support rods 22 and or arms 22*a* are supported in and by a U-shaped pivoting bracket 22*b* in the encasement 14 which has three bracket-fixing holes 22*c* to coincide with fixed end apertures 23 in the support arms 22*a* and or rods 22. Each support arm 22*a* and or rod 22 is pivotally affixed to the pivoting bracket 22*b* by a bolt assembly having a bolt 22*d* and corresponding washer and threaded nut 22*e*, as shown in FIG. 26.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A boat awning device or system for mounting to a boat to selectively provide shade outside the boat over water, said boat awning comprising:

a canopy assembly having a canopy substrate and at least one support rod supporting said canopy substrate, said support rod having a fixed end and a free end;

a support base assembly that is mountable to the boat, said fixed end of said rod being pivotally connected to said support base assembly, said canopy being mounted to said rod between said fixed end and said free end;

said free end of said rod being pivotable away from said support base assembly to an opened position and retractable toward said support base to a closed position;

a locking means, in mechanical communication with said rod and said support base, for selectively locking said rod in said opened position or said closed position;

a plurality of said support rods, each of said support rods having a fixed end and a free end, each of said fixed ends being pivotally connected to said support base assembly proximal to each other, said canopy being mounted to said rods between said fixed ends and said free ends;

said support base assembly including an encasement defining a storage channel, said rod fixed end being pivotally connected to said encasement in said channel;

a fixing hole defined in each of said support rods proximal said fixed ends;

a plurality of bolt assemblies, each of said bolt assemblies being in mechanical communication with each one of said fixing holes for pivotally mounting each one of said support rods individually to said support base assembly;

a plurality of support arms corresponding to said support rods, each of said support arms supporting one of said support rods, said support rods having corresponding fixing holes coinciding with said fixing holes of said support rods, each of said bolt assemblies mating with each of said fixing holes of said support rods and said support arms; and a pivoting bracket defining a U-shaped channel said pivoting bracket having a plurality of fixing apertures corresponding in number to the number of said support rods, each of said support rods being pivotally connected by said bolt assemblies to said pivoting bracket through said fixing apertures.

2. The boat awning of claim 1, further comprising:

an encasement cover for covering said encasement channel.

3. The boat awning of claim 1, further comprising:

a support base mounting assembly for mounting said support base to the boat, said support base mounting assembly having a mounting beam extending from a ceiling mounting plate wherein said ceiling mounting plate is mountable to the boat for supporting said support base.

4. The boat awning of claim 1, further comprising:

a plurality of support base mounting assemblies for mounting said support base to the boat, each of said support base mounting assemblies having a mounting beam extending from a ceiling mounting plate wherein said ceiling mounting plate is mountable to the boat for supporting said support base on the boat.

5. The boat awning of claim 3, further comprising:

a support base mounting assembly for mounting said support base to the boat, said support base mounting assembly having a mounting beam extending from a ceiling mounting plate wherein said ceiling mounting plate is mountable to the boat for supporting said support base.

6. A boat awning device or system for mounting to a boat to selectively provide shade outside the boat over water, said boat awning comprising:

a canopy assembly having a canopy substrate and a plurality of support rods supporting said canopy substrate, said support rods each having a fixed end and a free end, each of said fixed ends having a fixing hole proximal said fixed ends;

a support base assembly that is mountable to the boat;

a plurality of support arms pivotally connected to said support base assembly, each of said support arms having a support arm fixed end and a fixing opening proximal each of said support arm fixed ends, each of said support rods being mounted to a corresponding one of said support arms such that said fixing holes align with said fixing opening, said canopy substrate being mounted to said support rods between said fixed ends and said free ends, said free end of said rods being pivotable away from said support base assembly to an opened position and retractable toward said support base to a closed position; and said support base assembly including an encasement defining a storage channel, said support rod fixed ends and said support arm fixed ends being in pivotal communication with said encasement in said channel, a plurality of bolt assemblies, each of said bolt assemblies being in mechanical communication with each one of said fixing holes and said fixing openings for pivotally mounting each of said support arms and said support rods individually to said support base assembly and a pivoting bracket defining a U-shaped channel, said pivoting bracket having a plurality of fixing apertures corresponding in number to the number of said support arms and said support rods, each of said support arms being pivotally connected by said bolt assemblies to said pivoting bracket through said fixing apertures, said fixing holes and said fixing openings.

7. The boat awning of claim 6, further comprising:

an encasement cover for covering said encasement channel.

8. The boat awning of claim 6, further comprising:

a locking means, in mechanical communication with said rod and said support base, for selectively locking said rod in said opened position or said closed position.

9. The boat awning of claim 6, further comprising:

a plurality of support base mounting assemblies for mounting said support base to the boat, each of said support base mounting assemblies having a mounting beam extending from a ceiling mounting plate wherein said ceiling mounting plate is mountable to the boat for supporting said support base on the boat.

10. The boat awning of claim 9, further comprising:

a locking means, in mechanical communication with said rod and said support base, for selectively locking said rod in said opened position or said closed position.

11. The boat awning of claim 6, further comprising:

a plurality of support base mounting assemblies for mounting said support base to the boat, each of said support base mounting assemblies having a mounting beam extending from a ceiling mounting plate wherein said ceiling mounting plate is mountable to the boat for supporting said support base on the boat.

12. The boat awning of claim 6, further comprising:

a support base mounting assembly for mounting said support base to the boat, said support base mounting assembly having a mounting beam extending from a ceiling mounting plate wherein said ceiling mounting plate is mountable to the boat for supporting said support base.

13. The boat awning of claim 6, further comprising:

a locking means, in mechanical communication with said rod and said support base, for selectively locking said rod in said opened position or said closed position.

* * * * *